US012571395B2

(12) United States Patent
Yakushiji et al.

(10) Patent No.: US 12,571,395 B2
(45) Date of Patent: Mar. 10, 2026

(54) COMPRESSOR

(71) Applicant: MITSUBISHI HEAVY INDUSTRIES THERMAL SYSTEMS, LTD., Tokyo (JP)

(72) Inventors: Shunsuke Yakushiji, Tokyo (JP); Takayuki Hagita, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 0 days.

(21) Appl. No.: 18/281,725

(22) PCT Filed: Feb. 9, 2022

(86) PCT No.: PCT/JP2022/005140
§ 371 (c)(1),
(2) Date: Sep. 12, 2023

(87) PCT Pub. No.: WO2022/201934
PCT Pub. Date: Sep. 29, 2022

(65) Prior Publication Data

US 2024/0151232 A1 May 9, 2024

(30) Foreign Application Priority Data

Mar. 24, 2021 (JP) ..... 2021-050355

(51) Int. Cl.
*F04C 29/06* (2006.01)
*F04B 39/00* (2006.01)
*F04C 23/02* (2006.01)

(52) U.S. Cl.
CPC ..... *F04C 29/06* (2013.01); *F04B 39/0044* (2013.01); *F04C 23/02* (2013.01)

(58) Field of Classification Search
CPC ..... F04C 29/00; F04C 29/06; F04C 29/02; F04B 39/121; F04B 39/0044
See application file for complete search history.

(56) References Cited

U.S. PATENT DOCUMENTS

2014/0003973 A1* 1/2014 Arai ..... F04B 39/121 903/902
2017/0040864 A1 2/2017 Takabe
(Continued)

FOREIGN PATENT DOCUMENTS

CN 109818437 A 5/2019
CN 11065822 A 4/2020
(Continued)

OTHER PUBLICATIONS

Takabe, 'Electric Compressor,' Mach. Trans. WO 2015/163039 (Year: 2015).*
(Continued)

*Primary Examiner* — Kenneth J Hansen
(74) *Attorney, Agent, or Firm* — BIRCH, STEWART, KOLASCH & BIRCH, LLP

(57) ABSTRACT

This compressor comprises a compressor body, an electric motor that has a rotating shaft extending along an axis and drives the compressor body via the rotating shaft, and a housing that houses the compressor body and the electric motor. The electric motor has a rotor capable of rotating about the axis and an annular stator centered about the axis. The housing has a housing body and a pair of highly rigid parts that are provided on the outer side of the housing body in positions opposite in the radial direction and that have higher rigidity than other portions. The stator is fixed to the inner peripheral surface of the housing at a plurality of fixing points provided at positions different from points where the housing intersects with a first straight line connecting the
(Continued)

pair of highly rigid parts and a second straight line orthogonal to the first straight line.

12 Claims, 2 Drawing Sheets

(56) References Cited

U.S. PATENT DOCUMENTS

| | | | |
|---|---|---|---|
| 2019/0157942 | A1 | 5/2019 | Futae et al. |
| 2020/0173443 | A1 | 6/2020 | Ichise et al. |

FOREIGN PATENT DOCUMENTS

| | | | | |
|---|---|---|---|---|
| CN | 111065822 | A | 4/2020 | |
| EP | 904962 | A2 * | 3/1999 | ..... B60H 1/00514 |
| JP | 2719819 | B2 | 2/1998 | |
| JP | 2002-233103 | A | 8/2002 | |
| JP | 2019-97279 | A | 6/2019 | |
| KR | 10-2007-0000310 | A | 1/2007 | |
| WO | WO-2015163039 | A1 * | 10/2015 | ..... F04B 35/04 |

OTHER PUBLICATIONS

International Search Report for International Application No. PCT/JP2022/005140, dated Mar. 15, 2022, with English translation.
Written Opinion of the International Searching Authority for International Application No. PCT/JP2022/005140, dated Mar. 15, 2022, with English translation.

* cited by examiner

COMPRESSOR

TECHNICAL FIELD

The present disclosure relates to a compressor.

Priority is claimed on Japanese Patent Application No. 2021-050355 filed on Mar. 24, 2021, the content of which is incorporated herein by reference.

BACKGROUND ART

A scroll compressor is known as, for example, one type of compressor mounted in an automobile. The scroll compressor includes a compressor body that compresses a refrigerant, an electric motor that drives the compressor body, and a housing that accommodates the compressor body and the electric motor. The electric motor has a rotor that is rotatable about an axis and a stator that covers the rotor from an outer peripheral side. The stator has an annular shape about the axis and is fixed to an inner peripheral surface of the housing by bolting or shrink-fitting (for example, PTL 1 below).

An attachment leg for fixing the scroll compressor at a predetermined position of the automobile is formed on an outer peripheral surface of the housing. For this reason, a portion where the attachment leg is formed has higher rigidity than other portions. A pair of attachment legs are provided at positions facing each other in a radial direction of the housing, and another pair of attachment legs are provided at other positions. It is known that in a case of considering a vibration mode associated with driving of the motor, vibrations occur in an elliptical mode in which a first straight line connecting the pair of attachment legs facing each other in the radial direction and a second straight line orthogonal to the first straight line are used as a minor axis or a major axis. Further, it is known that vibrations in the elliptical mode also occur in the stator since the stator has an annular shape.

CITATION LIST

Patent Literature

[PTL 1] Japanese Patent No. 2719819

SUMMARY OF INVENTION

Technical Problem

In a case where vibration modes of such a housing and such a stator are superimposed, vibrations diverge, and there is a possibility of noise of the compressor increasing.

The present disclosure is devised in order to solve the problems, and a compressor of which noise is further reduced can be provided.

Solution to Problem

According to an aspect of the present disclosure, in order to solve the problems, there is provided a compressor including a compressor body, an electric motor that has a rotating shaft extending along an axis and that drives the compressor body with the rotating shaft, and a housing that has a cylindrical shape about the axis and that accommodates the compressor body and the electric motor. The electric motor has a rotor that is rotatable about the axis and a stator that has an annular shape about the axis. The housing has a housing body and a pair of highly rigid portions that are provided on an outer side of the housing body with respect to the axis at positions facing each other in a radial direction and that have higher rigidity than other portions. The stator is fixed to an inner peripheral surface of the housing at a plurality of fixing points provided at positions different from points where the housing intersects a first straight line connecting the pair of highly rigid portions and a second straight line orthogonal to the first straight line.

Advantageous Effects of Invention

With the present disclosure, the compressor of which noise is further reduced can be provided.

DESCRIPTION OF EMBODIMENTS (Configuration of Compressor)

Figure 1:
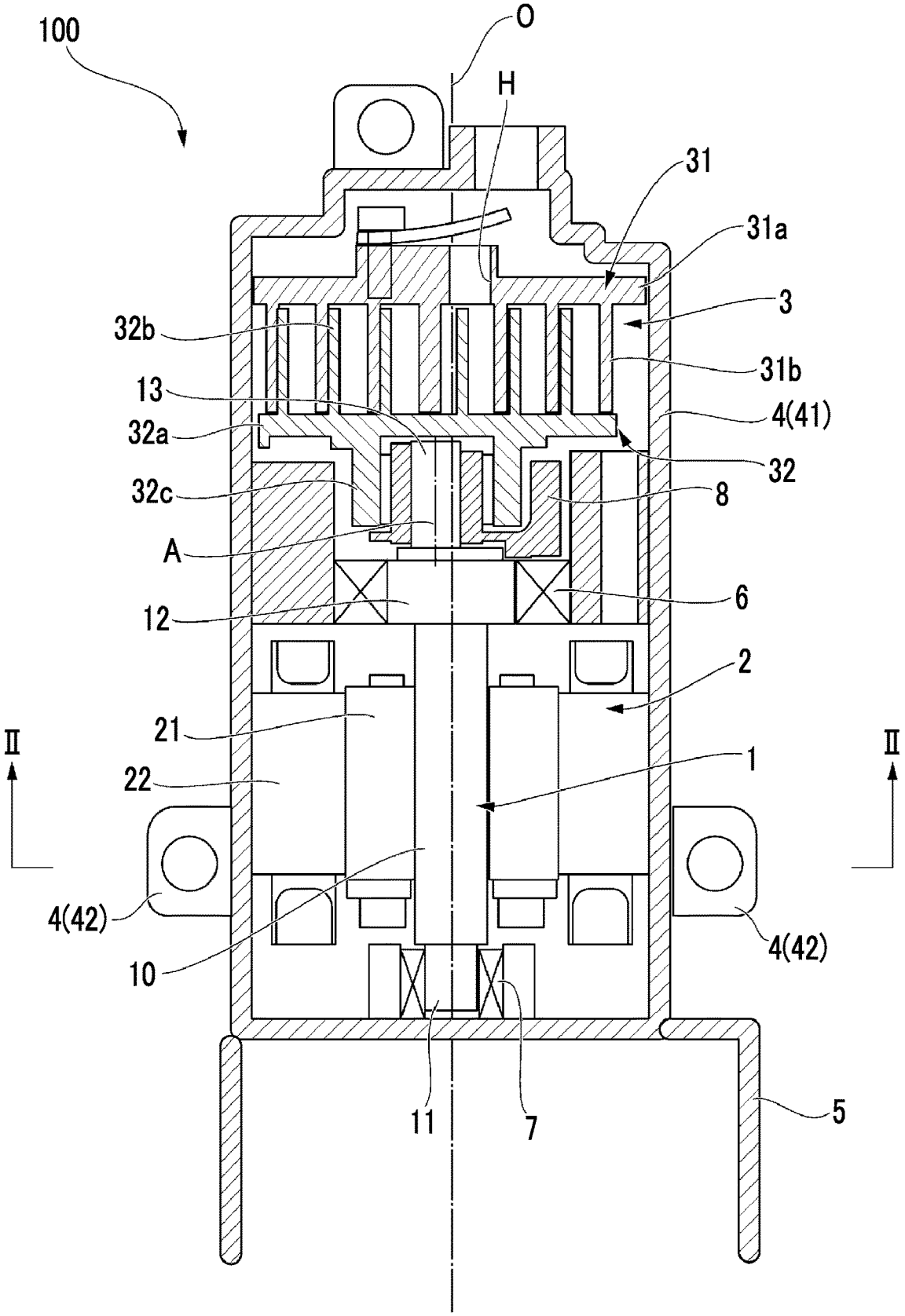
FIG. 1 is a sectional view showing a configuration of a compressor according to an embodiment of the present disclosure.

Hereinafter, a scroll compressor 100 that is a compressor according to an embodiment of the present disclosure will be described with reference to FIGS. 1 and 2. The scroll compressor 100 is used in order to compress, for example, a refrigerant for a vehicle air conditioning device. As shown in FIG. 1, the scroll compressor 100 includes a shaft 1 (rotating shaft), a motor 2 (electric motor), a compressor body 3, a housing 4, a cover 5, an upper bearing 6, a lower bearing 7, and a drive bush 8.

(Configuration of Shaft)

The shaft 1 extends along an axis O and is rotatable about the axis O. The shaft 1 has a shaft body 10, a small-diameter portion 11, a large-diameter portion 12, and an eccentric shank 13. The shaft body 10 has a cylindrical shape about the axis O. The shaft body 10 has a uniform diameter dimension over the entire region in an axis O direction. A rotor 21 (to be described later) of the motor 2 is attached to an outer peripheral surface of the shaft body 10.

The small-diameter portion 11 is provided on one side (lower side) of the shaft body 10 in the axis O direction. The small-diameter portion 11 has a cylindrical shape about the axis O and has a diameter dimension smaller than that of the shaft body 10. The small-diameter portion 11 is supported by the lower bearing 7 attached to the housing 4 from the one side (lower side) in the axis O direction.

The large-diameter portion 12 is provided on the other side (upper side) of the shaft body 10 in the axis O direction. The large-diameter portion 12 has a cylindrical shape about the axis O and has a diameter dimension larger than that of the shaft body 10. The large-diameter portion 12 is supported by the upper bearing 6 fixed to the housing 4 from a radial direction.

The eccentric shank 13 is provided on a further upper side (the other side in the axis O direction) of the large-diameter portion 12. The eccentric shank 13 protrudes from the large-diameter portion 12 toward the other side in the axis O direction. The eccentric shank 13 has a cylindrical shape about an eccentric axis A that is parallel to the axis O and that extends at a position shifted from the axis O in the radial direction. Therefore, when the shaft 1 rotates, the eccentric shank 13 revolves (turns) about the axis O.

(Configuration of Motor)

The motor 2 applies a rotational driving force to the shaft 1. The motor 2 has the rotor 21 and a stator 22. The rotor 21 is fixed to the shaft body 10. The rotor 21 has a cylindrical shape about the axis O. Although not shown in detail, the rotor 21 has a plurality of magnets. The stator 22 covers the rotor 21 from an outer peripheral side. The stator 22 is formed by laminating a plurality of steel plates in the axis O direction and winding a copper wire (configuring a coil). By energizing the stator 22, an electromagnetic force is generated between the stator 22 and the rotor 21, and a rotational force about the axis O is applied to the rotor 21. Accordingly, the shaft 1 rotates about the axis O.

(Configuration of Compressor Body)

The compressor body 3 is driven by the rotation of the shaft 1 caused by the motor 2. The compressor body 3 has a fixed scroll 31 and a movable scroll 32. The fixed scroll 31 has a first end plate 31*a* having a disk shape about the axis O and a first spiral plate 31*b* provided on the one side (lower side) of the first end plate 31*a* in the axis O direction. The first spiral plate 31*b* extends spirally about the axis O. The fixed scroll 31 is fixed to the housing 4.

The movable scroll 32 has a disk-shaped second end plate 32*a*, a second spiral plate 32*b* provided on the other side (upper side) of the second end plate 32*a* in the axis O direction, and a boss portion 32*c*. The second spiral plate 32*b* extends spirally about the axis O. The dimension of the second spiral plate 32*b* in the axis O direction is equal to the dimension of the first spiral plate 31*b* described above in the axis O direction. As the first spiral plate 31*b* and the second spiral plate 32*b* mesh with each other from the axis O direction, a compression chamber is formed therebetween.

The boss portion 32*c* is a cylindrical portion protruding from the second end plate 32*a* toward the one side (lower side) in the axis O direction. The boss portion 32*c* is attached to the eccentric shank 13 of the shaft 1 via the drive bush 8. As the eccentric shank 13 turns about the axis O, a turning force is transmitted to the movable scroll 32 through the drive bush 8. Accordingly, the movable scroll 32 turns about the axis O. Although not shown in detail, the rotation (spinning) of the movable scroll 32 itself is restricted by an Oldham ring.

As the movable scroll 32 turns, the volume of the compression chamber described above changes with time, a refrigerant is compressed while being sent from a radial outer side to a radial inner side in the compression chamber, and the pressure increases. The refrigerant in a high-pressure state is guided into the housing 4 through an opening H formed in the first end plate 31*a* of the fixed scroll 31.

The housing 4 has a housing body 41 and an attachment leg 42 (highly rigid portion). The housing body 41 is a bottomed cylindrical container that accommodates the shaft 1, the motor 2, and the compressor body 3. The attachment leg 42 is a member for fixing the scroll compressor 100 at a predetermined position. As shown in FIG. 2, a pair of attachment legs 42 are provided at positions facing each other in a radial direction passing through the axis O. A portion of the housing body 41 in which the attachment leg 42 is provided has a rigidity higher than other portions by the amount of thickness.

The cover 5 is attached to one side (lower side) of the housing body 41 in the axis O direction. Although not shown in detail, an electrical component including an intelligent power module (IPM) is accommodated inside the cover 5.

(Relationship Between Stator and Housing)

Figure 2:
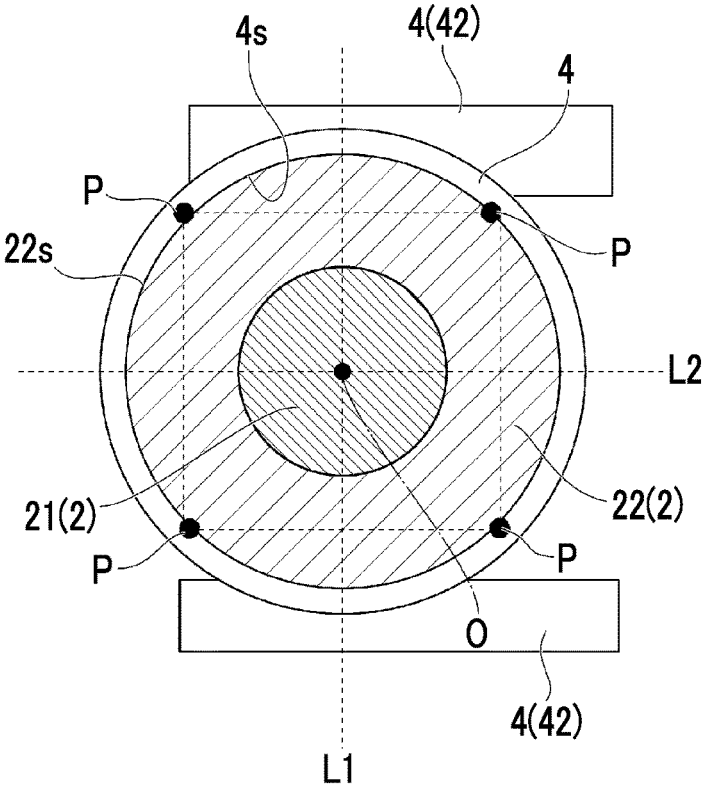
FIG. 2 is a sectional view taken along line II-II of FIG. 1.

As shown in FIG. 2, the stator 22 of the motor 2 is fixed to an inner peripheral surface 4*s* of the housing 4 by shrink-fitting. More specifically, an outer peripheral surface 22*s* of the stator 22 is in a state of being tightly fitted to the inner peripheral surface 4*s* of the housing 4 at four fixing points P disposed in a square shape at equal intervals. Herein, a straight line connecting the pair of attachment legs 42 described above is called a first straight line L1, and a straight line orthogonal to the first straight line L1 is called a second straight line L2.

Since the housing body 41 has a circular cross section, vibrations are likely to occur in an elliptical mode having the first straight line L1 and the second straight line L2 as a major axis or a minor axis. The four fixing points P are disposed at positions different from points where the housing body 41 intersects each of the first straight line L1 and the second straight line L2. In other words, the four fixing points P are not positioned on the first straight line L1 and the second straight line L2. In addition, the fixing points P are provided at positions rotated by 45° with respect to the first straight line L1 and the second straight line L2. Therefore, any of the fixing points P is geometrically most distant from the points where the housing body 41 intersects the first straight line L1 and the second straight line L2.

(Operational Effects)

Herein, it is known that during operation of the scroll compressor 100, vibrations in the elliptical mode described above also occur in the stator 22 in addition to the housing body 41. In a case where the elliptical mode of the housing body 41 and the elliptical mode of the stator 22 are superimposed (that is, a case where major axis directions and minor axis directions of the two elliptical modes match each other), there is a possibility of vibrations in both modes being synthesized and eventually diverging.

Thus, in the present embodiment, the four fixing points P are disposed at the positions different from the points where the housing body 41 intersects each of the first straight line L1 and the second straight line L2. Accordingly, the minor axes and the major axes do not overlap each other between the elliptical mode of the housing body 41 and the elliptical mode of the stator 22. Accordingly, a probability of vibrations diverging can be reduced. As a result, noise of the scroll compressor 100 can be reduced.

In addition, with the above configuration, since the plurality of fixing points P are disposed at equal intervals, deformation of the stator 22 is unlikely to be biased in a circumferential direction. As a result, occurrence of vibrations in the elliptical mode can be further suppressed.

Herein, the electric motor is generally driven by a three-phase alternating current. For this reason, in a case where the number of fixing points is a multiple of 3, there is a possibility of vibrations excited by an electromagnetic force based on each current resonating or developing with the passage of time. However, with the above configuration, since four fixing points are provided in a square shape instead of a multiple of 3, a probability of this happening can be reduced.

The embodiment of the present disclosure has been described hereinbefore. It is possible to make various changes and improvements in the configurations without departing from the gist of the present disclosure. For example, an example in which the stator 22 is shrink-fitted to the housing 4 at the fixing points P has been described in the embodiment. However, an aspect of the fixing points P is not limited to shrink-fitting, and it is possible to adopt a configuration where the stator 22 is fastened to the housing 4 by a bolt.

Figure 3:
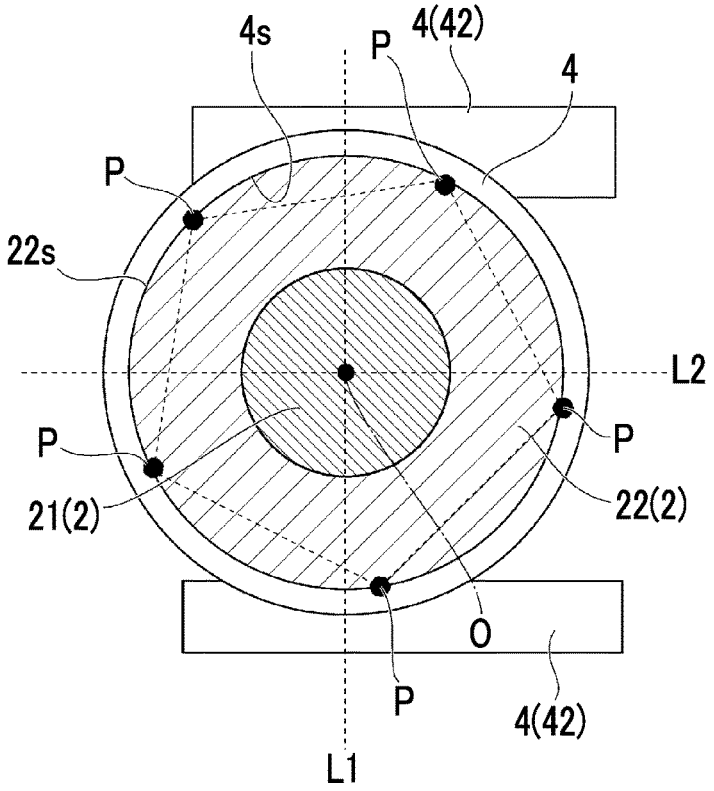
FIG. 3 is a sectional view showing a modification example of the compressor according to the embodiment of the present disclosure.

Further, an example in which the four fixing points P are disposed in a square shape has been described in the embodiment. However, as shown in FIG. 3 which is a modification example, it is also possible to dispose five fixing points P in a regular pentagonal shape. Also in this case, none of the fixing points P is positioned on the first straight line L1 and the second straight line L2. Even with this configuration, just as with the four fixing points P disposed in a square shape, a probability of resonance occurring with respect to vibrations based on a three-phase alternating current can be reduced.

<Appendix>

The compressor (scroll compressor 100) described in each embodiment is understood, for example, as follows.

(1) The compressor according to a first aspect has the compressor body 3, the electric motor (motor 2) that has the rotating shaft (shaft 1) extending along the axis O and that drives the compressor body 3 with the rotating shaft, and the housing 4 that has a cylindrical shape about the axis O and that accommodates the compressor body 3 and the electric motor. The electric motor has the rotor 21 rotatable about the axis O and the stator 22 having an annular shape about the axis O. The housing 4 has the housing body 41 and the pair of highly rigid portions (attachment legs 42) that are provided on an outer side of the housing body 41 with respect to the axis O at positions facing each other in the radial direction and that have higher rigidity than other portions. The stator 22 is fixed to the inner peripheral surface of the housing 4 at the plurality of fixing points P provided at the positions different from the points where the housing 4 intersects the first straight line L1 connecting the pair of highly rigid portions and the second straight line L2 orthogonal to the first straight line L1.

With the above configuration, the elliptical mode of vibrations of the housing 4 and the elliptical mode of vibrations of the stator 22 do not overlap each other. Accordingly, a probability of vibrations diverging can be reduced.

(2) In the compressor according to a second aspect, the plurality of fixing points P are disposed at an equal interval in the circumferential direction with respect to the axis O.

With the above configuration, since the plurality of fixing points P are disposed at an equal interval, deformation of the stator 22 is unlikely to be biased in the circumferential direction. As a result, occurrence of vibrations in the elliptical mode can be further suppressed.

(3) In the compressor according to a third aspect, the plurality of fixing points P are disposed in a square shape.

Herein, the electric motor is generally driven by a three-phase alternating current. For this reason, in a case where the number of fixing points P is a multiple of 3, there is a possibility of vibrations excited by an electromagnetic force based on each current developing with the passage of time. However, with the above configuration, since four fixing points P are provided in a square shape instead of a multiple of 3, a probability of this happening can be reduced.

(4) In the compressor according to a fourth aspect, the plurality of fixing points P are disposed in a regular pentagonal shape.

Herein, the electric motor is generally driven by a three-phase alternating current. For this reason, in a case where the number of fixing points P is a multiple of 3, there is a possibility of vibrations excited by an electromagnetic force based on each current developing with the passage of time. However, with the above configuration, since five fixing points P are provided in a regular pentagonal shape instead of a multiple of 3, a probability of this happening can be reduced.

INDUSTRIAL APPLICABILITY

With the present disclosure, the compressor of which noise is further reduced can be provided.

REFERENCE SIGNS LIST

100: scroll compressor
1: shaft
2: motor
3: compressor body
4: housing
4*s*: inner peripheral surface
5: cover
6: upper bearing
7: lower bearing
8: drive bush
10: shaft body
11: small-diameter portion
12: large-diameter portion
13: eccentric shank
21: rotor
22: stator
22*s*: outer peripheral surface
31: fixed scroll
31*a*: first end plate
31*b*: first spiral plate
32: movable scroll
32*a*: second end plate
32*b*: second spiral plate
32*c*: boss portion
41: housing body
42: attachment leg
A: eccentric axis
H: opening
L1: first straight line
L2: second straight line
O: axis
P: fixing point

The invention claimed is:

1. A compressor comprising:

a compressor body;

an electric motor that has a rotating shaft extending along an axis and that drives the compressor body with the rotating shaft; and a housing that has a cylindrical shape about the axis and that accommodates the compressor body and the electric motor, wherein the electric motor has a rotor that is rotatable about the axis, and a stator that has an annular shape about the axis, the housing has a housing body, and a pair of attachment legs that are provided on an outer side of the housing body with respect to the axis at positions facing each other in a radial direction and that are fixed to the housing body a pair of first portions of the housing on which the pair of attachment legs are provided are thicker than a second portion of the housing between the pair of first portions in a circumferential direction with respect to the axis, the pair of first portions have higher rigidity than the second portion by the amount of thickness, the stator is fixed to an inner peripheral surface of the housing at a plurality of fixing points provided at positions different from points where the housing intersects a first straight line connecting the pair of first portions and a second straight line orthogonal to the first straight line, and the plurality of fixing points are disposed at the positions geometrically most distant from the points where the housing intersects the first straight line and the second straight line on the inner peripheral surface of the housing as viewed from the direction of the axis.

2. The compressor according to claim 1, wherein the plurality of fixing points are disposed at an equal interval in a circumferential direction with respect to the axis.

3. The compressor according to claim 1, wherein the plurality of fixing points are disposed in a square shape.

4. The compressor according to claim 1, wherein the plurality of fixing points are disposed in a regular pentagonal shape.

5. The compressor according to claim 2, wherein the plurality of fixing points are disposed in a square shape.

6. The compressor according to claim 2, wherein the plurality of fixing points are disposed in a regular pentagonal shape.

7. A compressor comprising:

a compressor body;

an electric motor that has a rotating shaft extending along an axis and that drives the compressor body with the rotating shaft; and a housing that has a cylindrical shape about the axis and that accommodates the compressor body and the electric motor, wherein the electric motor has a rotor that is rotatable about the axis, and a stator that has an annular shape about the axis, the housing has a housing body, and a pair of attachment legs that are provided on an outer side of the housing body with respect to the axis at positions facing each other in a radial direction and that are fixed the housing body a pair of first portions of the housing on which the pair of attachment legs are provided are thicker than a second portion of the housing between the pair of first portions in a circumferential direction with respect to the axis, the pair of first portions have higher rigidity than the second portion by the amount of thickness, the stator is fixed to an inner peripheral surface of the housing at a plurality of fixing points provided at positions different from points where the housing intersects a first straight line connecting the pair of first portions and a second straight line orthogonal to the first straight line, and when vibrations in the elliptical mode having one of the first straight line and the second straight line as a major axis and the other one as a minor axis occur, the minor axes and the major axes are shifted from each other between the elliptical mode of the housing body and the elliptical mode of the stator.

8. The compressor according to claim 7, wherein the plurality of fixing points are disposed at an equal interval in a circumferential direction with respect to the axis.

9. The compressor according to claim 7, wherein the plurality of fixing points are disposed in a square shape.

10. The compressor according to claim 7, wherein the plurality of fixing points are disposed in a regular pentagonal shape.

11. The compressor according to claim 8, wherein the plurality of fixing points are disposed in a square shape.

12. The compressor according to claim 8, wherein the plurality of fixing points are disposed in a regular pentagonal shape.

* * * * *